United States Patent [19]

Vandenberg

[11] Patent Number: 4,822,309

[45] Date of Patent: Apr. 18, 1989

[54] COMBINED LIFE PRESERVER CUSHION AND TOTE BAG

[76] Inventor: John A. Vandenberg, 3186 Petaluma Ave., Long Beach, Calif. 90808

[21] Appl. No.: 59,324

[22] Filed: Jun. 8, 1987

Related U.S. Application Data

[63] Continuation-in-part of Ser. No. 832,037, Feb. 21, 1986, abandoned.

[51] Int. Cl.[4] ..... A45C 9/00

[52] U.S. Cl. ..... 441/35; 441/125; 297/180; 5/465

[58] Field of Search ..... 441/35, 80, 125, 126, 441/127, 129, 130; 24/591; 5/462, 465, 466; 150/55, 106; 297/456, 250, 216, 217, 188

[56] References Cited

U.S. PATENT DOCUMENTS

| | | | |
|---|---|---|---|
| 65,901 | 6/1867 | Golding et al. | 441/35 |
| 410,304 | 9/1889 | Walters et al. | 24/591 |
| 3,763,972 | 10/1973 | Karzmar et al. | 5/465 |
| 4,190,918 | 3/1980 | Harvell et al. | 5/465 |
| 4,242,767 | 1/1981 | McMullen et al. | 5/465 |
| 4,459,714 | 7/1984 | Lin | 5/465 |

*Primary Examiner*—Joseph F. Peters, Jr.
*Assistant Examiner*—Edwin L. Swinehart
*Attorney, Agent, or Firm*—Julius Rubinstein

[57] ABSTRACT

The invention comprises generally square buoyant cushions. A separate fabric skirt is attached to each side of each cushion. Each skirt has fastening means so the skirts on one cushion can be fastened to the skirts on another cushion. If the cushions are stacked one on top of another, and the skirts of the stacked cushions are connected together, the skirts are sufficiently long so the buoyant compartment formed by the facing surfaces of the cushions and the connected skirts of the cushions will have sufficient volume for storing emergency supplies. In another configuration the skirts on the cushions can be connected together in side by side relationship to form a chain of buoyant cushions or a raft which can support a number of people so they will not drift apart in the water.

11 Claims, 3 Drawing Sheets

FIG. 1.
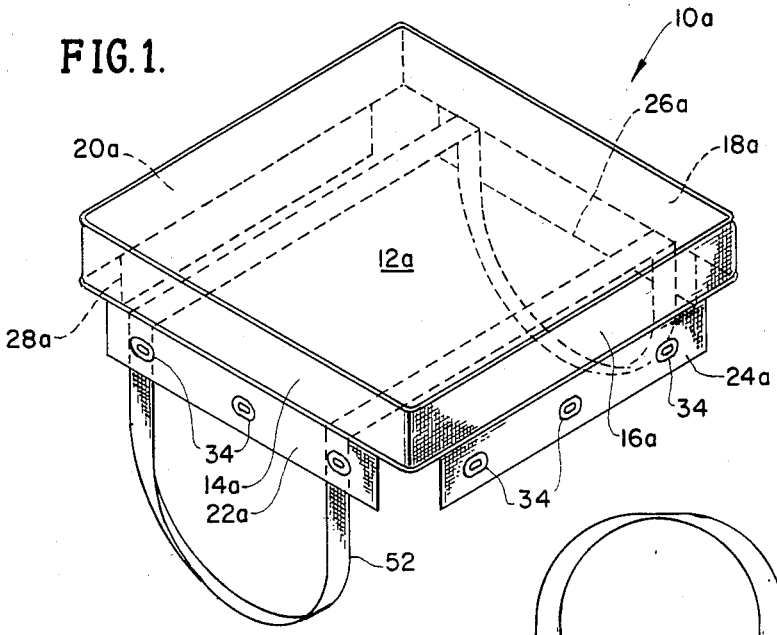
FIG. 3.
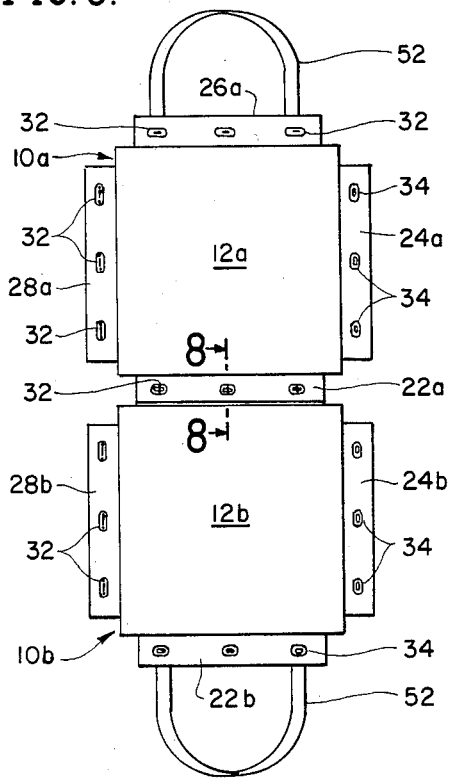
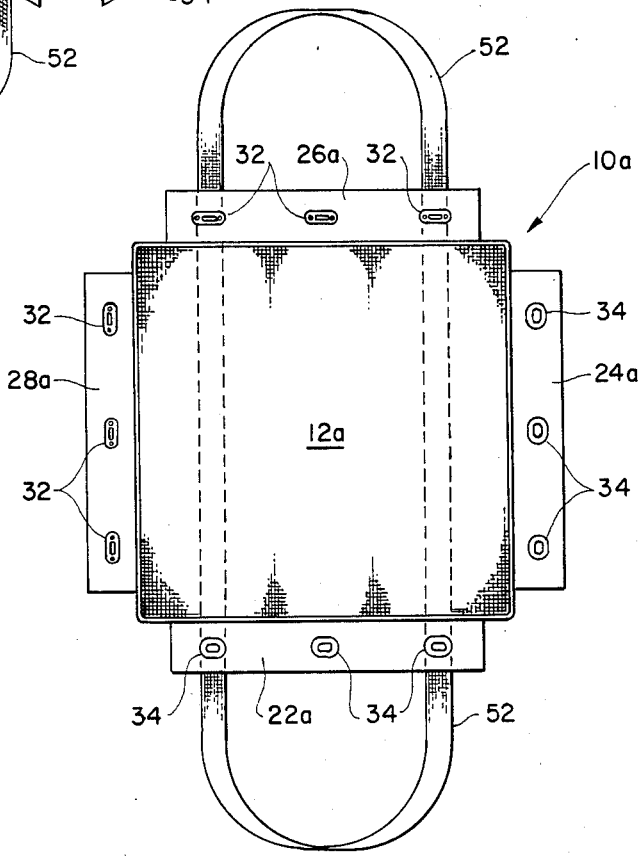
FIG. 2.
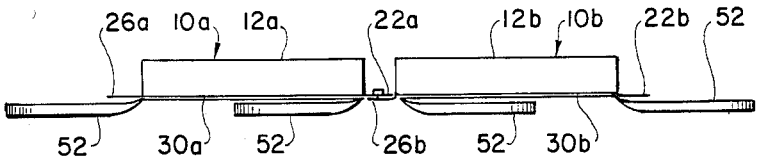
FIG. 4.

FIG. 7.
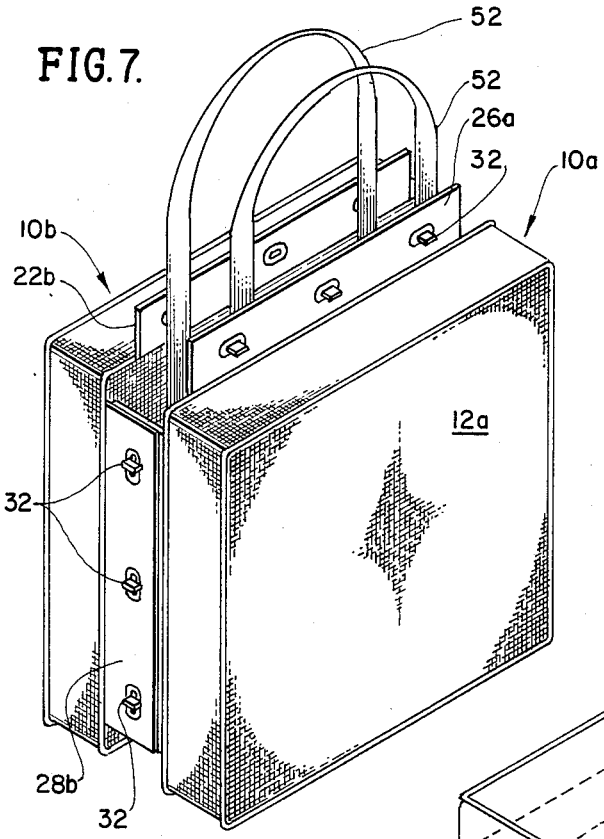
FIG. 7a.
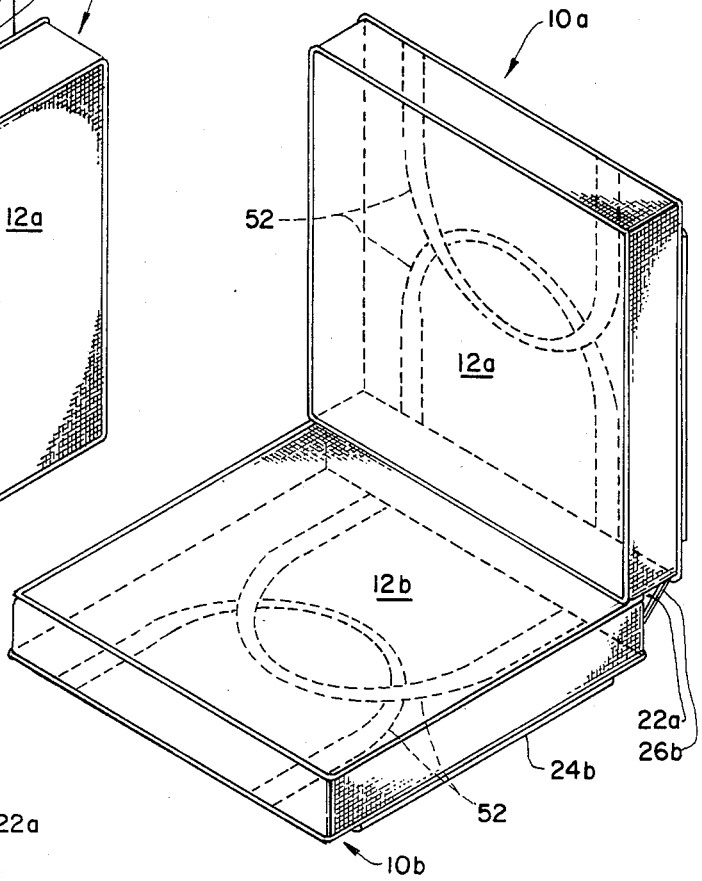
FIG. 8.
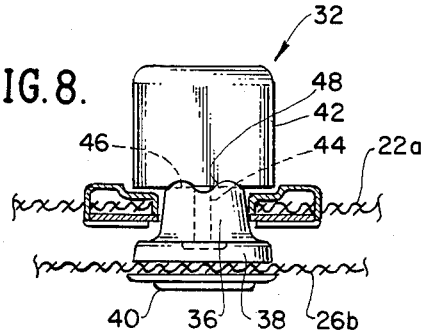
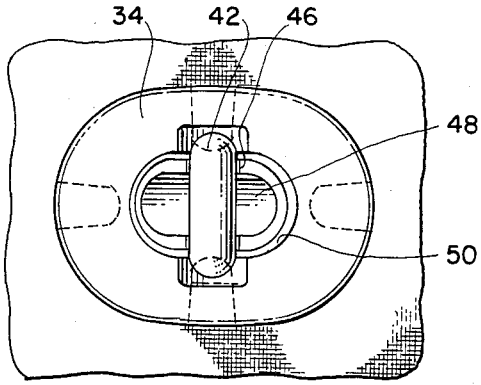
FIG. 9.
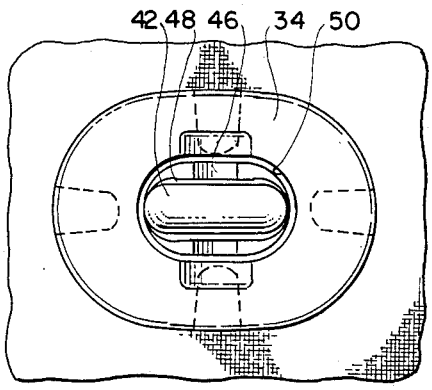
FIG. 10.

COMBINED LIFE PRESERVER CUSHION AND TOTE BAG

This is a continuation in part of patent application Ser. No. 832,037 filed Feb. 21, 1986 now abandoned.

This invention relates generally to buoyant life preserver cushions which can be connected together to form a chain of cushions or a buoyant compartment for storing emergency supplies, or which can be connected together to form a tote bag which can carry blankets and food and beverages and which can be reconnected in such a way that one cushion serves as a seat cushion and the other cushion serves as a cushioned back rest.

PRIOR ART AND BACKGROUND OF INVENTION

Life preserver cushions have long been used in boats. Some as exemplified by the patent to Golding U.S. Pat. No. 65901 and Wood U.S. Pat. No. 264814 are designed to be connected together and can form a raft sufficient in size to support a number of persons and to carry emergency provisions.

Typically the life preserver cushions have a buoyant polyethelene foam core positioned inside a surrounding cover of water impervious material. When not used in an emergency situation they serve as cushions on the boat. The advantage of this use is that they are kept above deck so that in an emergency they can, as exemplified by the patents cited above, be connected together and thrown in the water where they can support a number of persons.

The advantage of using floatation cushions that can be connected together is that in an emergency situation the people in the water clinging to the connected cushions will stay together where they can help each other, and they will be more visible. Consequently, they can be more easily found be searchers, than a single person holding on to a single seat cushion.

However emergencies can happen very fast, and when a boat has to be abandoned there may be no time to gather emergency supplies.

There may be only enough time to abandon ship and cling to the cushions. Once in the water the persons clinging to the cushions may be able to connect the cushions together.

SUMMARY OF INVENTION

The present invention is a rectangular seat cushion designed to be used as a life preserver. The seat cushion is formed from a polyethelene foam pad encased in a water impervious fabric cover. In addition, the cushion is provided with a fabric border or skirt extending outwardly from all four sides of the pad. In this particular embodiment, male fasteners are located on two adjacent skirts of the pad, and female fasteners are located on the remaining adjacent skirts of the pad. The male and female fasteners are designed to be releasably interlocked with each other. In this way an unlimited number of seat cushions can be connected together to form a life raft or a chain of cushions.

In an alternate arrangement, two cushions can be stacked one on top of the other in such a way that the skirts of one cushion can be interlocked with the skirts of the other cushion to form a storage compartment defined by the facing surfaces of the cushions and the connected skirts of the cushions which form the walls of the compartment. This compartment would be filled with emergency supplies, prior to need. In this way if an emergency occured, the connected stacked cushions when thrown in the water would contain emergency supplies such as flares, a radio transmitter, and some food and water where it would serve as a flotation device and a floating container for emergency supplies.

In another use, cushions, which need not be buoyant, can be connected together to form a tote bag filled with a blanket and food and beverages. In this use, the tote bag would be carried, for example, to a football game, and the cushions separated in such a way that one cushion serves as seat cushion, and the other cushion serves as a cushioned back rest. Alternatively the cushions can be completely seperated so both serve as seat cushions while the blanket and supplies carried in the compartment are available for us.

The above described objects of this invention along with other objects will become more apparent when better understood in the light of the accompanying specification and drawings wherein:

FIG. 1 is a perspective view of a single seat cushion constructed according to the principles of this invention.

FIG. 2 is a top plan view of the cushion shown in FIG. 1.

FIG. 3 is a top plan view of two cushions connected together.

FIG. 4 is a side elevational view of the cushions shown in FIG. 3.

FIG. 7 is a perspective view disclosing another use of the cushions wherein they are connected together to form a tote bag.

FIG. 7*a* is a perspective view of the cushions shown in FIG. 7 wherein the tote bag has been disconnected in such a way as to form a cushioned seat and back rest.

FIG. 8 is an enlarged sectional detail taken on the line 8—8 of FIG. 3.

FIG. 9 is an enlarged top plan view of the male and female fasteners connected together in a locked condition.

FIG. 10 is an enlarged top plan view of the male and female fasteners shown in FIG. 9 in an unlocked condition.

Figure 11:
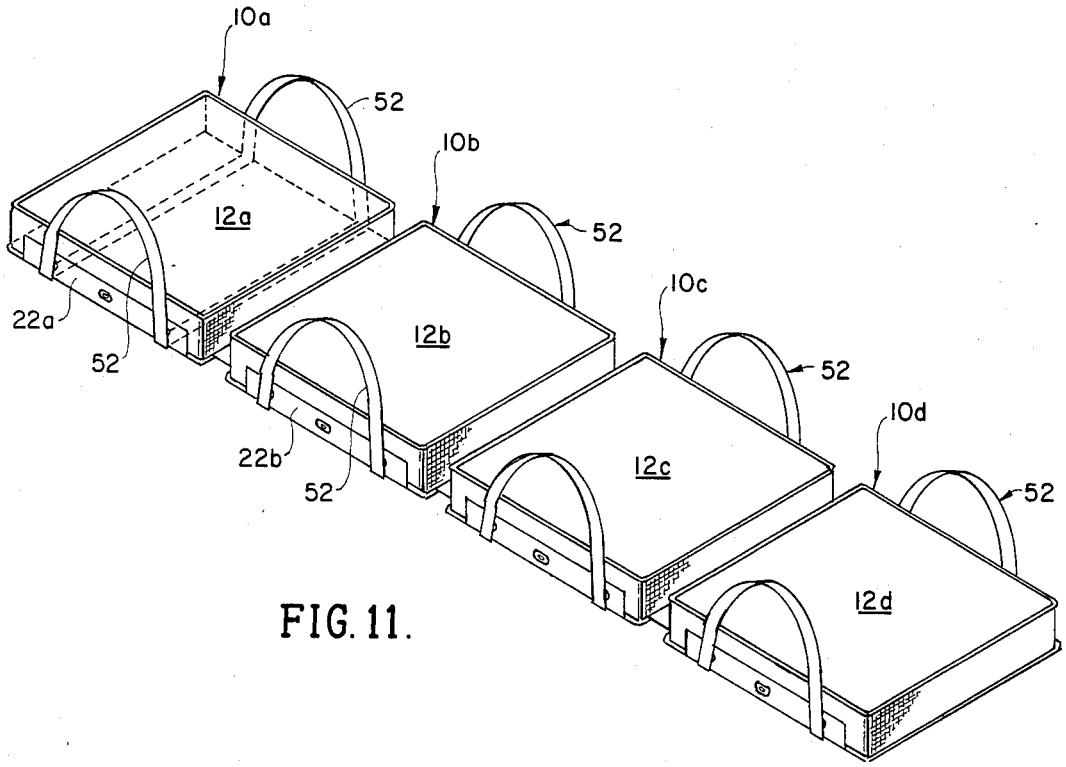

FIG. 11 discloses another use of the cushions wherein a plurality of cushions are connected together to form an emergency stretcher or litter for carrying disabled persons.

Referring now to FIG. 1 of the drawing, a single floatation cushion indicated generally by the reference numeral 10*a*, comprises a generally planar surface 12*a*, side surfaces 14*a*, 16*a*, 18*a*, 20*a*, and a generally planar bottom surface 30*a*, see FIG. 1 and 4. As seen in FIG. 2, the cushion is generally square in shape and is constructed from a buoyant pad of polyethelene foam encased in a canvas cover. In the embodiment shown, the cushion is approximately fifteen inches on a side and three inches in thickness.

As shown in FIG. 2 four generally rectangular, fabric skirts 22*a*, 24*a*, 26*a*, and 28*a*, formed from a canvas like material extend out from each side of the cushion about two inches and in the same plane as the bottom surface 30*a*, see FIG. 4. As seen in FIG. 3, the length of the skirts connected to the edge of the bottom surface of the cushion are no longer than the length of the connected edge of the bottom surface of the cushion, and in this embodiment are substantially shorter. This permits the skirts to be bent individually without affecting the other skirts.

The skirts 26*a* and 28*a* at adjacent sides or corners of the cushion are provided, in this particular embodiment, with male fastening members 32, while skirts 22*a* and 24*a* at the opposite sides or corners of the cushion are provided with female fastening members 34. In this particular embodiment, each skirt is provided with three fastening members, either male or female although, under some circumstances a different number may be provided. In addition canvas straps 52 are attached to the bottom surface 30*a* extending, in this embodiment, from opposite sides of the cushion to provide hand holds or arm holds for a person in the water, see FIG. 2.

Each male fastening member 32 comprises an upstanding pedestal 36 which rises from a base 38. The base 38 is securely attached to a skirt by means of a pair of rivet connections 40. Each male fastener 32 has an elongated flat, narrow twistable head 42 which is rotatably mounted relative to the pedestal 36 by means of an integral vertical connecting post 44 which is rotatably mounted in the upper surface of the pedestal 36. see FIGS. 9 and 10. The twistable head seats in either of two perpendicular pairs of grooves or detent depressions 46 and 48 formed in the upper surface of the pedestal. With this arrangement the twistable head will tend to remain in one or the the other of the orthogonal positions. Moreover, this arrangement permits the head 42 to be twisted to the correct position in the dark, because when the head is rotated the person making the connection can feel when the head is aligned properly with the groove.

Each female fastening member 34 is a reinforced grommet or eyelet having an elongated opening 50 extending therethrough and having a length sufficient to accomodate insertion of the head 42 of the male fastening members 32 when the head 42 is aligned lengthwise with the opening 50 as illustrated in FIG. 10. When the head 42 is twisted perpendicular to the alignment with the opening 50, as depicted in FIG. 9, it is releasably locked to the female fastening member 34. In this position, the head 42 resides in registration with the detent depression 46*b* in the upper surface of the grommet 34.

The cushions are normally used as seat cushions in a boat. In the event the boat capsizes or sinks the cushions will bob to the surface and a person in the water can bring two of the cushions together and sequentially align each male fastening member on one skirt to a female fastening member on a skirt on another cusihon and then insert the head 42 of the male fastening member on one cushion into the opening 50 in the female member on another cushion. Then the head 42 would be twisted so it is at right angles to the opening. In this way, any number of cushions can be connected together to form a life raft or a chain of cushions, as illustrated in FIG. 11. By way of illustration, two cushions 10*a* and 10*b* are connected together see FIGS. 3 and 4 with the heads 42 on skirt 26*b* attached to cushion 10*b* inserted in the openings 50 in skirt 24*a* attached to cushion 10*a* to hold the cushions together.

Figure 5:
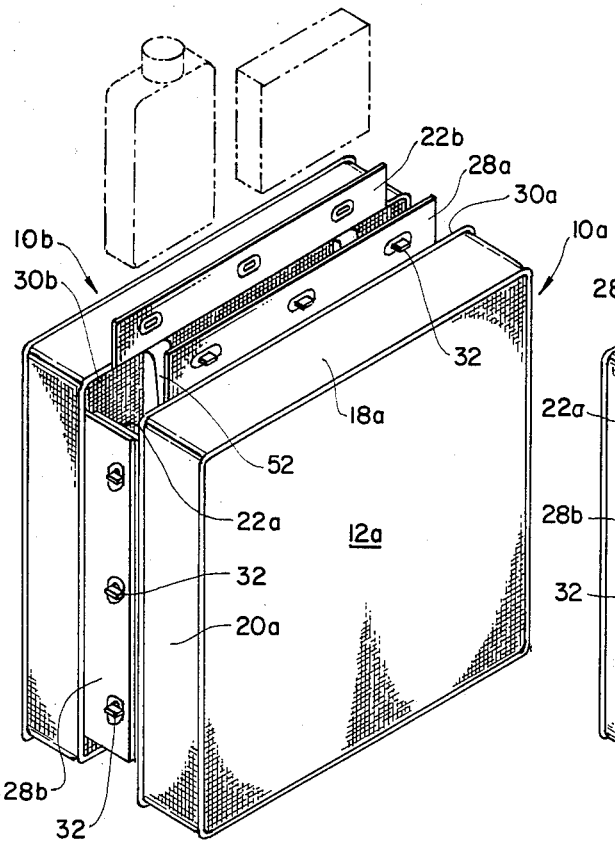
FIG. 5 is a perspective view of two cushions connected together to form a compartment for emergency supplies with two skirts left unconnected and serving as the opening to the container.
Figure 6:
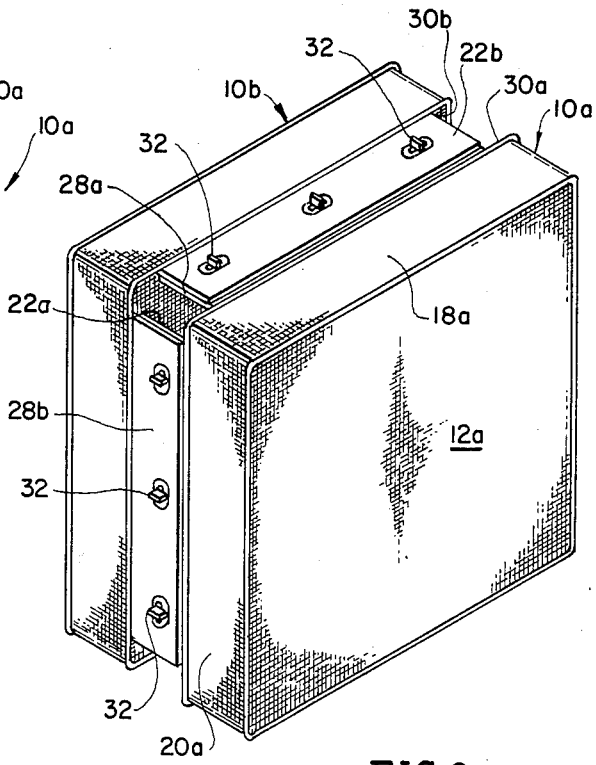
FIG. 6 is a perspective view of the cushions shown in FIG. 5 but with the skirts forming the opening to the container connected together closing off the compartment and securing the emergency supplies in the compartment.

As stated above, emergencies can happen very fast, as when a boat suddenly capsizes or sinks and there may be no time to gather emergency supplies. In anticipation of such an event, two cushions can be connected together, one on top of the other, to form a compartment for the storage of emergency supplies as shown in FIG. 5 and 6. In this configuration, the cushions are stacked so surface 30*a* on cushion 10*a* and surface 30*b* on cushion 10*b* face each other. The male fastening members on skirt 28*b* attached to cushion 10*b* are connected to the female fastening members on skirt 22*a* attached to cushion 10*a*. The male fastening members 26*b* attached to cushion 10*b* are connected to the female fastening members on skirt 24*a* attached to cushion 10*a*. The male fastening members on skirt 26*a* attached to cushion 10*a* are connected to the female fastening members on skirt 24*b* attached to cushion 10*b*, leaving skirts 22*b* attached to cushion 10*b* and skirts 28*a* attached to cushion 10*a* unconnected to serve as the opening for the insertion or the emergency supplies indicated in dotted lines in FIG. 5.

When all the emergency supplies have been stored, the male fastening members on skirt 28*a* attached to cushion 10*a* are connected to the female fastening members on skirt 22*b* attached to cushion 10*b* to hold the emergency supplies in the compartment defined by the facing surfaces 30*a* and 30*b*, and the walls of the compartment defined by the connected skirts as shown in FIG. 5 and 6. It is understood that the size of the containers holding the emergency supplies is larger than the openings at the corners of the compartment so that supplies stored in the compartment cannot fall out.

In this particular embodiment the cushions are about fifteen inches on each side and the skirts are about two inches long. Consequently the compartment formed by connecting the cushions as shown in FIGS. 5 and 6 would have a volume of about 450 cubic inches which is large enough to store flares, an emergency radio, a flashlight, and some high energy food. If required the size of the compartment could be varied by changing the size of the cushions or the length of the skirts.

When the cushions are stacked as shown in FIGS. 6 with the emergency supplies in the compartment described above, the cushions could still be used to sit on. But in an emergency as when the boat capsizes, the stacked cushions with the emergency supplies stored in the compartment would bob to the surface of the water where they could be used by persons in the water.

A land use of the cushions described above is contemplated. In this use two cushions are connected to form a combined tote bag and seat and back cushion as shown in FIGS. 7 and 7*a*. In this use, the cushions are connected together on three sides with the strap members fastened and assembled as shown in FIG. 7 positioned to be used as hand grips for the tote bag. A blanket and food and beverages may be carried in the compartment of the tote bag. If the tote bag formed this way were taken, for example, to a football game, the cushions would be separated to form a cushioned seat and cushioned back rest or two seperate cushioned seats and the blanket and other supplies, such as food and beverages would be conveniently available.

In addition, although the drawings disclose a pair of identical rectangular cushions, it is contemplated that the cushions could have shapes which are not rectangular and with pairs of cushions which are not identical.

For example, the cushions could be circular having peripheral skirts which extend out beyond the periphery of the cushion far enough so they can be connected to the peripheral skirts on another cushion. Moreover although the skirts are described as formed from a fabric, other materials which are not fabric or flexible, are contemplated. For example the skirts could be formed from a rigid plastic connected to the periphery of the cushion by a narrow strip of fabric or by stitching or by glue.

It is also noted that the invention could be practiced using only one cushion. Referring to FIG. 5 it is evident that if cushion 10*a* were decreased in thickness until it was a thin sheet of fabric or a plastic like material, with the skirts 22*a*, 24*a*, 26*a*, and 28*a*, attached to it, the sheet 10*a* would become the cover of the compartment. In this way either an aquatic safety device or a tote bag having a storage compartment could be formed using one cushion and a cover.

Having described the invention what I claim as new is:

1. A combined aquatic safety device and tote bag comprising a pair of rectangular buoyant cushions stacked one on top of the other, each cushion comprising a top surface and a generally rectangular planar bottom surface, said top and bottom surfaces on each cushion connected together by four side surfaces, the bottom planar surfaces on the stacked cushions facing each other, four separate rectangular skirts on each cushion extending out beyond each of the four edges of the said bottom surface of the cushion, the length of the part of the skirt connected to each edge of the bottom surface of a cushion selected so each skirt can be bent transverse with respect to the bottom surface of the cushion without affecting the other skirts, means on each skirt on one stacked cushion adapted to be connected to another skirt on the other cushion, the width of each skirt sufficiently long so that if the cushions are stacked one on top of the other and the skirts are bent transverse to the bottom surface of the cushion so the skirts extend toward each other, and overlap each other enough to be attached together by said connecting means to form a supply compartment between the facing bottom surfaces of cushions with walls of the supply compartment defined by the overlapping connected skirts on the stacked cushions.

2. The aquatic safety device described in claim 1 wherein the top and bottom surfaces of each cushion are generally planar.

3. The aquatic safety device described in claim 1 wherein the connecting means include male fastening members secured to two of the skirts attached to each cushion and female fastening members are secured to the remaining two skirts on each cushion whereby the skirts on one cushion can be attached to the skirts on another cushion..

4. The aquatic safety device described in claim 3 wherein male fastening members are secured to adjacent skirts on one corner of the cushion and female fastening members are secured to the adjacent skirts at the opposite corner of the cushion, whereby the male fastening members secured to the skirts of one cushion may be attached to the skirts of another cushion so that any number of cushions can be connected together to form a raft.

5. The combined aquatic safety device described in claim 4 wherein said male fastening members comprise rotatably mounted heads, said rotatably mounted heads located at spaced intervals with respect to each other on two of the skirts of each cushion, a plurality of female fastening members on the remaining two skirts of each cushion, said female fastening members comprising head receiving openings extending through the skirt, the rotatably mounted heads on the skirts of one cushion adapted to penetrate the head receiving openings on the skirts of another cushion, the width of the rotatably mounted heads larger than the width of the head receiving openings so when a rotatably mounted head extends through a head receiving opening and is rotated transverse to said head receiving opening, the male and female fasteneing members are locked together to form a raft or a pair of stacked cushions with a compartment formed between them.

6. The aquatic safety device described in claim 5 including means associated with said male and female fastening members for feeling when the rotatably mounted head is transverse to the said head receiving openings whereby the rotatably mounted heads can be rotated transverse to the head receiving openings in the dark to lock the male and female fastening members together.

7. The aquatic safety device described in claim 6 wherein said means for locking and unlocking said male and female fastening members in the dark comprise transverse grooves associated with each rotatably mounted head, one groove aligned with a head receiving opening and one groove transverse to said head receiving opening, whereby when the rotatably mounted head in a head receiving opening is rotated so it is transverse to a head receiving opening and is in the groove transverse to said head receiving opening, the rotation of said head until said head engages the groove transverse to the length of the head receiving opening can be felt in the dark, whereby the male and female fastening members can be locked and unlocked in the dark.

8. The aquatic safety device described in claim 7 wherein each of said male fastening members comprises a pedestal, said pedestal having a top surface, said transverse grooves formed in the top surface of said pedestal, said rotatably mounted head having an integral post depending therefrom, said post rotatably mounted in said top surface of said pedestal.

9. An aquatic safety device comprising a plurality of rectangular buoyant cushions, each cushion comprising a rectangular top surface and a generally planar rectangular bottom surface, said top and bottom surfaces on each cushion connected together by four side surfaces, four separate rectangular skirts on each cushion, each rectangular skirt connected to an edge of the bottom surface of the cushion and substantially in the plane of the bottom surface of the cushion and extending out beyond the edge of said bottom surface of the cushion, means on each skirt on one cushion for attachment to another skirt on another cushion, the width of each skirt long enough so if the cushions are close enough together and the skirts extend toward each other in the plane of the bottom surface of the cushion, the skirts overlap each other sufficiently so the skirts can be attached together to hold the cushions in side by side relationship whereby the cushions form a raft formed from any number of cushions, so persons holding on to the raft will not drift apart.

10. A combined aquatic safety device and a tote bag comprising a pair of substantially identical rectangular buoyant cushions stacked one on top of the other, each cushion positioned so the bottom surface of each cushion faces each other, said top and bottom surfaces connected to each other by four side surfaces attached to the edges of said top and bottom surfaces, separate rectangular skirts secured to each of the said bottom surfaces and extending out beyond each of the four edges of said bottom surface of each cushion, skirt fastening means releasably secured to each of the said skirts in such a way that the skirts on one cushion can be connected to the skirts on another cushion to form an emergency storage compartment defined by the facing bottom surfaces of cushions and side walls formed by the connected skirts of the cushions, a skirt of each cushion being initially unconnected together to serve as the mouth of the compartment so that supplies can be inserted in the compartment and then the pair of unconnected skirts can be connected together to close the mouth of the compartment to hold the supplies inside the compartment.

11. A combined aquatic safety device and tote bag comprising a pair of rectangular cushions stacked one on top of the other, said cushions having a top surface and a bottom surface, and stacked so the bottom surface of each cushion faces each other, said top and bottom surfaces connected together by four side surfaces, four separate rectangular skirts, each rectangular skirt connected to an edge of the bottom surface of the cushion and substantially in the plane of the bottom surface of the cushion and extending out beyond the edge of the bottom surface of the cushion, the length of the part of the skirt being connected to the edge of the bottom surface of the cushion in such a way that each skirt can be bent transverse with respect to the bottom surface of the cushion without affecting the other skirts, means on each skirt for connection to another skirt, the width of each skirt sufficiently long so that if the cushions are stacked one on top of the other and the skirts are bent transverse to the bottom surface of the cushion so the skirts on one cushion extend toward the skirts on another cushion, the skirts overlap each other enough so they can be connected together by said connecting means to form a supply compartment between the facing bottom surfaces of cushions with walls of the supply compartment defined by the said connected skirts, whereby blankets, food and beverages can be stored in said compartment, said means for connecting said skirts together arranged so the skirts can be partially disconnected to permit the stacked cushions to be opened transverse to each other so one cushion can serve as a cushioned seat and the other cushion can serve as a cushioned back rest, while the blanket, food and beverages carried in the compartment are available for use.

* * * * *